United States Patent [19]

Schiller

[11] 4,043,601

[45] Aug. 23, 1977

[54] ASPHALT CUTTER

[76] Inventor: Raymond Paul Schiller, 905 N. Draper Road, McHenry, Ill. 60050

[21] Appl. No.: 662,545

[22] Filed: Mar. 1, 1976

Related U.S. Application Data

[63] Continuation-in-part of Ser. No. 509,093, Sept. 25, 1974, abandoned.

[51] Int. Cl.[2] ..... E02D 17/13; E01C 23/09

[52] U.S. Cl. ..... 299/36

[58] Field of Search ..... 172/719, 722, 699; 37/193; 299/36, 37, 38

[56] References Cited

U.S. PATENT DOCUMENTS

| | | | |
|---|---|---|---|
| 970,818 | 9/1910 | Harryman | 37/193 |
| 2,401,139 | 5/1946 | Cook | 37/193 |
| 2,689,419 | 9/1954 | Daniels et al. | 172/699 UX |
| 2,783,699 | 3/1957 | Kelly | 299/36 X |
| 2,878,002 | 3/1959 | Haley | 299/36 |
| 2,984,029 | 5/1961 | Pederson | 299/36 |
| 3,268,012 | 8/1966 | Ratkowski | 172/719 X |
| 3,592,509 | 7/1971 | Soderlund | 299/36 |
| 3,885,833 | 5/1975 | Lemieux | 299/36 |

FOREIGN PATENT DOCUMENTS

| | | | |
|---|---|---|---|
| 402,843 | 12/1932 | United Kingdom | 299/36 |

*Primary Examiner*—Ernest R. Purser
*Assistant Examiner*—William F. Pate, III
*Attorney, Agent, or Firm*—Darbo, Robertson & Vandenburgh

[57] ABSTRACT

A cutting device is disclosed having an angled lifter blade with flat co-planar keepers on each side which is adapted to pass through or under a layer of asphalt or soil cement and cut a narrow trench without disruption or upheaval of the side edges of the trench. The cutting device is carried by a prime mover and is capable of making a clean cut or trench through asphalt layers of various thicknesses along straight or curved paths of travel. The side keepers may be vertically adjustable along a supporting shank in relation to the lifter blade and the length of the blade may be varied to adjust to differing thicknesses of the layer to be cut. The side keepers are spaced from each other by the sides of the lifter blade to define therewith a pair of cutting edges, one of which is at an angle to the horizontal or grade of the asphalt layer and the other of which is substantially flush with the top surface of the asphalt. The keepers being flush with the two surfaces of the asphalt immediately in the vertical line of the cut prevent any upheaval along the cutting edges. The angle of the lifter blade to the keepers is preferably about 40°.

18 Claims, 13 Drawing Figures

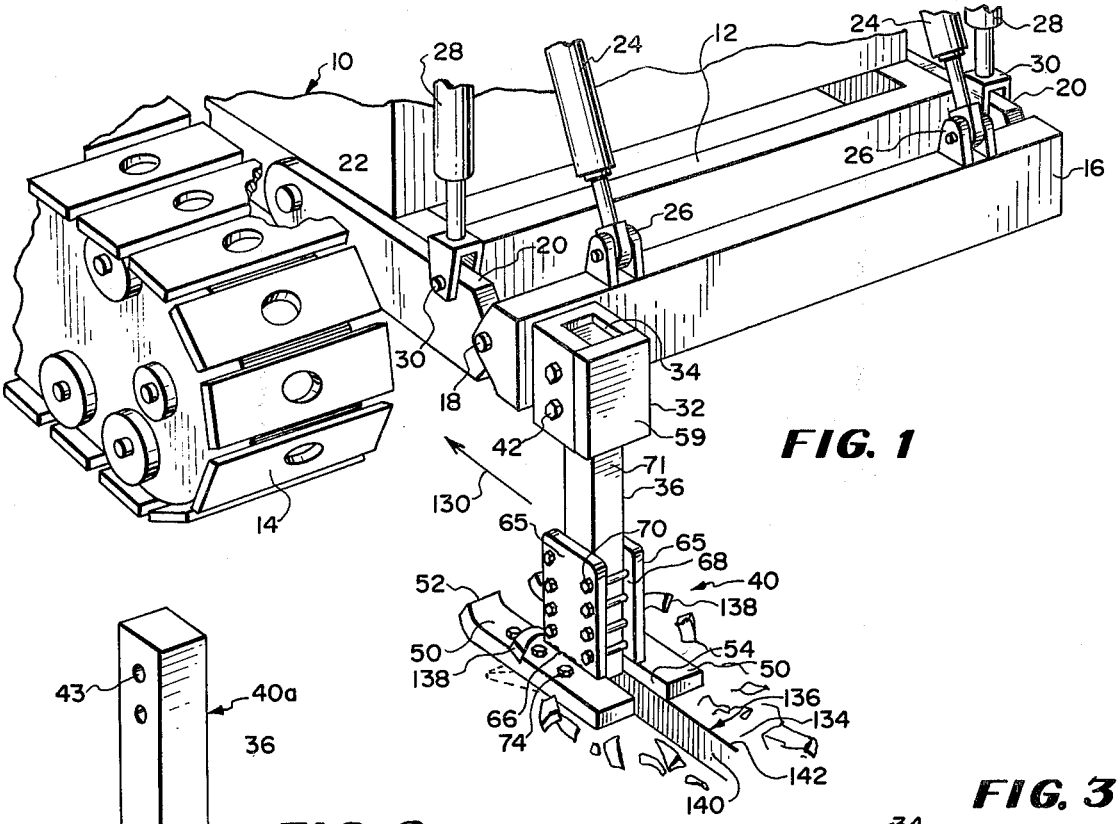
FIG. 1
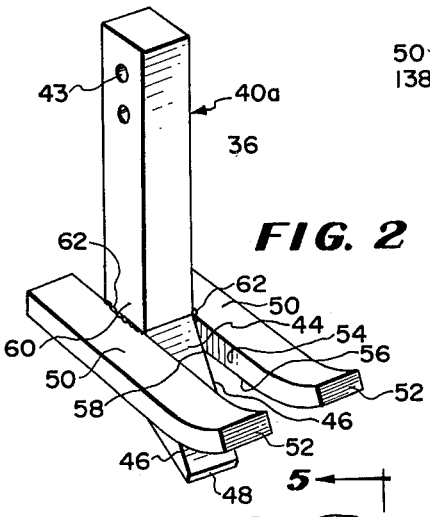
FIG. 2
FIG. 3
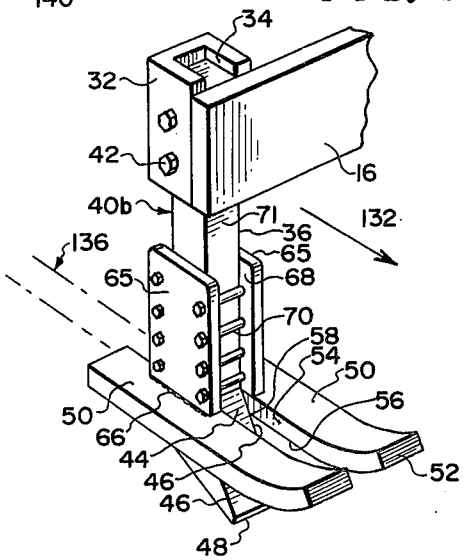
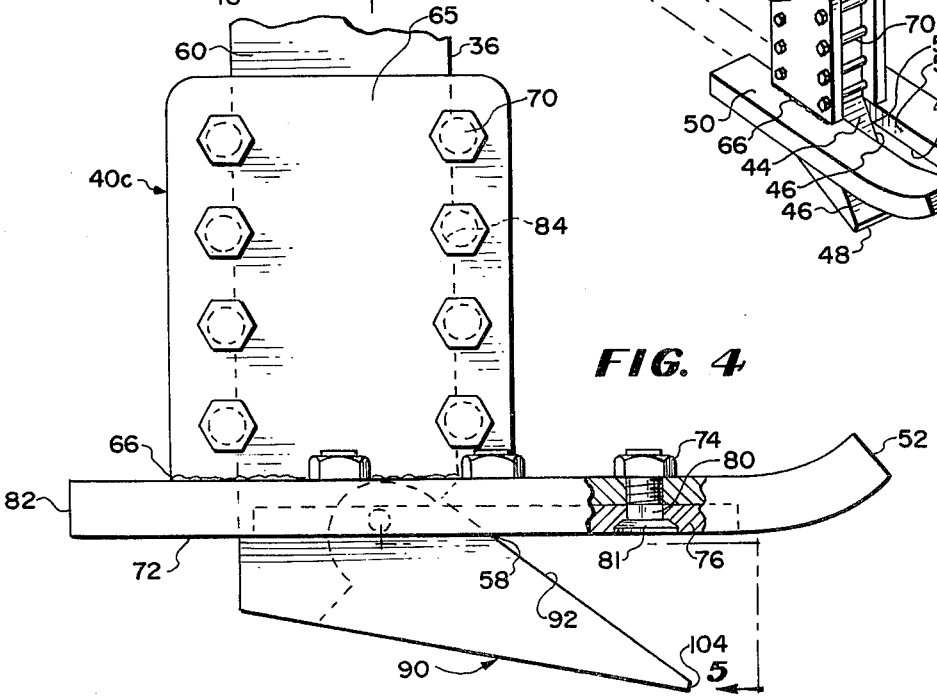
FIG. 4

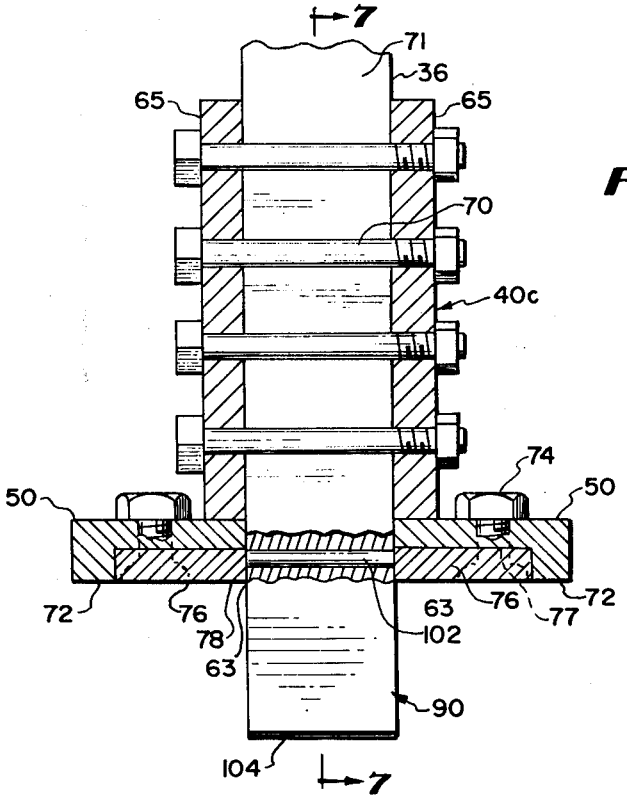
FIG. 5
FIG. 6
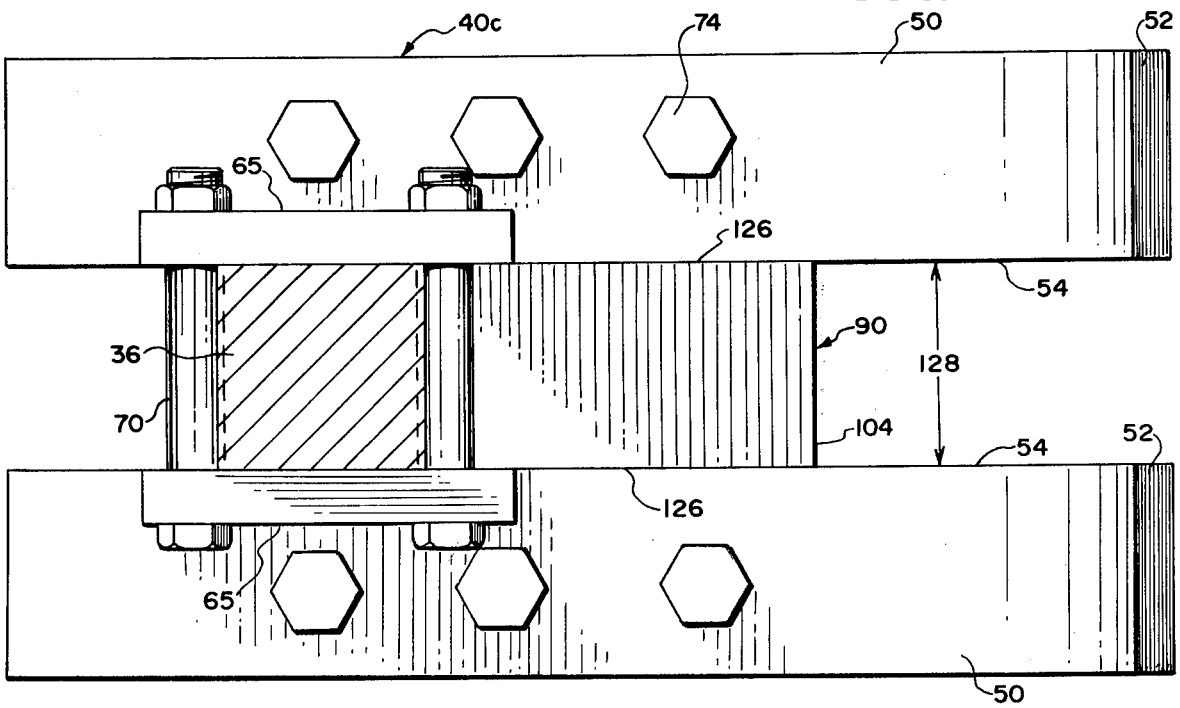

ASPHALT CUTTER

RELATED APPLICATION

This application is a continuation-in-part of application Ser. No. 509,093, filed Sept. 25, 1974 now abandoned.

THE PRIOR ART

A number of devices are known in the prior art employing both stationary and oscillating cutters to form a suitable trench or ditch in asphalt or the like for the purpose of laying conduits or wires therein. CRAIG Ser. No. 11,055 has the objective of cutting such a trench in a layer of asphalt roadbed without disturbing the surface of the roadbed adjacent the line of cut. CRAIG uses upright frames which are laterally adjustable so as to vary the width of the trench. A pair of 500 lb. hammers carrying one or more cutting tools is carried between the upright frames to penetrate, on being dropped, the roadbed surface and free same for hand removal of the broken pieces. The hammers are alternately hoisted and freed to drop by gravity. On withdrawal of the cutting tool at the end of the hammers a pair of pressure plates or shoes is arranged at each side of the cutting tool so that when the plates are depressed they bear onto the surface at each side of the line of work. These pressure plates are carried by slide bars and stems held down by heavy springs and are also oscillated vertically at each advance of the machine. The tool cuts by penetration and the action of the pressure plates is intermittent in this device.

Other prior art asphalt and pavement cutters or breakers using oscillating or rotating beaters have pressure plates on wheels serving the same purpose in a laterally spaced relationship from the tools. Thus, in PUTNAM U.S. Pat. No. 2,768,794 the pressure wheels are both forwardly and laterally spaced from the area of pavement slab being broken. In HALEY U.S. Pat. No. 2,878,002, the oscillating blade is of lesser width than the transport wheels which serve as pressure members. McGEE U.S. Pat. No. 3,034,238 pulls a plurality of spaced cutters under a moldboard in a scarifying action. Others such as GAMMIE Ser. No. 828,734 provide laterally spaced rotary cutting saws operating ahead of and on the sides of a lifting blade. SODERLUND U.S. Pat. No. 3,592,509 uses roller hold-downs that operate along the edge of the cut ahead of a pair of transversely spaced lifting tools that are offset on their outer edges from the cut and have their top edges laterally inclined from the edge of the cut. Only the bottom of the tools are immediately adjacent the cut. SODERLUND's tools have sloping blades to lift or curl the pavement inwardly from the cut edges.

SUMMARY OF THE INVENTION

In accordance with this invention an asphalt cutter is provided with a pair of flat co-planar keepers, one on each side of a flat-sided lifter blade with the inner edges thereof coincidental with the outer flat cutting edges of the lifter blade whereby the asphalt is cut as the tool advances and is stripped upwardly and falls to the sides of the trench, leaving a clean straight-edged cut. By placing the keepers at a predetermined angle of about 40° to the angle of the lifter blade the cutter operation is made more efficient and operates with the least power. The cutter may be adjusted for depth either by adjusting the level of the keepers or by using different lengths of lifter blade.

DESCRIPTION OF THE DRAWINGS

Several embodiments of the invention are illustrated in the drawings wherein:

FIG. 1 shows a prime mover carrying the cutter device of this invention as its working tool;

FIG. 2 is a perspective view of a simple form of cutter device of this invention;

FIG. 3 is a fragmentary perspective view of an adjustable form of the cutter being pushed by a prime mover;

FIG. 4 is a fragmentary partial sectional side view of the cutter of FIG. 3 with modifications;

FIG. 5 is a cross-sectional view taken along the lines 5—5 of FIG. 4;

FIG. 6 is a top view of the cutter device of FIG. 3;

DESCRIPTION OF THE PREFERRED EMBODIMENT

Figure 7:
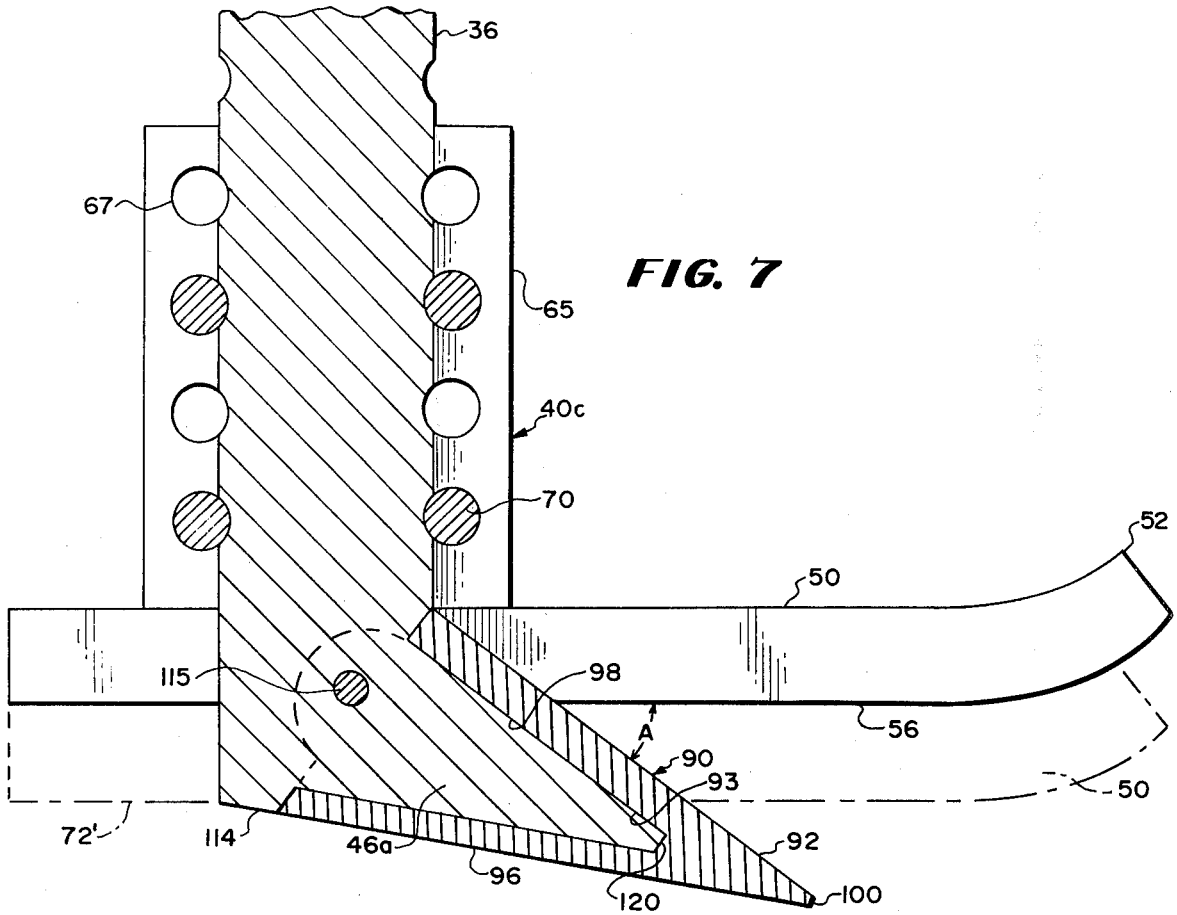
FIG. 7 is a cross-sectional view taken along the lines 7—7 of FIG. 5.

Referring to FIG. 1, there is shown a prime moving machine 10 having a frame 12 carried by the traction means 14, in this instance illustrated by a tractor unit. At least a pair of such tractor units would be used to support the machine and provide the necessary pulling or pushing force required. Prime movers equipped with rubber tires can also be used.

A machine of this type is equipped with an adjustable header, bucket or draw bar, as illustrated by the beam 16 used for the attachment of various working tools such as scraper blades and scarifier teeth. Means are provided for adjusting such tools in relation to the grade being traversed, raising and lowering the tool and holding it in proper working position. These means are illustrated by the transverse pivot 18 at one end of the beam 16 and a second pivot (not shown) at the other end of the beam 16, which are connected to the extended ends of the pair of elongated draft arms 20 extending along each side of the frame 12. The draft arms 20 are pivoted at 22 to the frame, again only one such pivot point shows in the drawing. In order to rotate the beam 16 on the pivots 18 in relation to the draft arms 20 a pair of double acting rams 24 is provided, connected at their upper ends to the machine and each pivotally mounted at the pivots 26 to the top of the beam 16. These mountings can extend upwardly from the beam to increase the leverage and purchase of the rams, as desired. The means for lifting the beam 16 is illustrated by the pair of double acting rams 28 which are each pivotally mounted to the draft arms 20 at the pivots 30. The hydraulic system for the control of the rams by the operator of the machine is not illustrated since the means to accomplish these adjustments do not constitute a part of this invention and any form of adjustment means can be usd. For example, instead of adjusting the beam 16 in relation to the frame, the adjustment can be between the wheels or tractors and the frame.

The beam 16 includes one or more mountings 32 which can be the same as are employed for ripper or scarifier blades, comprising a housing defining a vertical opening 34 to receive the shank 36 of the trench cutting tool 40 of this invention. The shank 36 can be held in the mounting 32 by any means such as the bolts 42 which extend through bore holes 43 (FIG. 2) in the shank to form a rigid attachment.

The tool 40 of FIG. 1, shown being pulled by the prime mover 10, is to be considered as incorporating the basic principles of the tool 40*a* of FIG. 2 as well as all or part of the modifications thereof to be described in relation to the tool 40*b* of FIG. 3 and the tool 40*c* of FIGS. 4–8. Those parts which are common to all embodiments bear the same reference numbers for simplicity, although altered in structure.

The cutting tool 40 of this invention is shown in its simplest form by the unitary tool 40*a* in FIG. 2 to include the shank 36 having the integral tapered and angled forward-projecting blade portion 44 at the lower end with cutting edges 46 along each side or top corner. A hardened square or blunted cutting tip 48 is provided at the end, with a pair of identical keeper plates or shoes 50 on each side. The plates or keepers 50 have upturned front ends 52 to aid in sliding over the asphalt and coplanar flat bottom surfaces (referred to as 72 in FIG. 4 to be described) which intersect with the inside surfaces or walls 54 to define a pair of cutting edges or corners 56 along the lengths of the keepers. The cutting edges or corners 46 of the lifter blade or tooth portion 44 and the cutting edges 56 intersect at the front corner 58 on each side of the tool where shearing action is completed and above and beyond which the severed strip of material slides up along the top end of the inclined surface of the blade and then to one side of the cutter. In this form of the device, the blade 44 and keepers 50 form the cutter head which is driven through the layer to be cut by means of shank 36.

Referring to the embodiments of FIGS. 1–8A, in order that the tools 40 can be rigidly held in the mounting 32 with no tendency to twist on a vertical axis, their shank members 36 can by any cross-sectional configuration conforming to the opening 34 so that these parts fit in a reasonably tight relationship. For this purpose the shank member 36 and the opening 34 can be of corresponding square cross section as illustrated. Splining of the shank 36 within the opening 34 can also be used to lock the tool rigidly in the mounting 32. The end plate 59 (FIG. 1), an integral part of the mounting, takes a major part of the thrust as the tool is pulled along. The lower opposite sides 60 of the shank 36 and the tooth portion 44 are preferably flat and parallel so that the two keepers 50 can be attached thereto in co-planar and parallel relationship. For convenience in fabricating the tool 40*a*, the keepers 50 can be welded thereto as indicated by the weldment 62. However, the lower longitudinal juncture of the flat bottoms 72 of the keepers and the planar sides 60 of the shank member 36 is a sharp 90° corner. This is best seen in FIG. 5 by the corners 63 of tool 40*c* incorporating wear plates, to be described.

The keepers 50 of the tool 40*a* shown in FIG. 2 are accordingly not adjustable in relation to the shank 36. The keepers are long enough and are positioned so that their coplanar bottoms and cutting edges 56 extend along above the full length of lifter blade 44 and intersect along the cutting edges 46 of the angled blade to define the final shear corners 58.

The tool 40*a* performs the same functions as the tool 40 shown in the remaining figures of the drawings. In testing the tool 40*a*, it has been found that the bottom surfaces 72 of the keepers 50 adjacent the cutting edges 56 in an area around the corners 58 are subject to wear as well as the angled cutting edges 46 of the lifter blade 44. Furthermore, since the layers of asphalt or soil cement to be cut are of varying thickness and trenches of different depth may be desired, means for adjustment of the keepers 50 in relation to the blade add to the utility of the tool.

Also, it is advantageous to maintain the tip 48 of the tool at or below the bottom surface of the asphalt layer, i.e., at or into the sub-grade, to decrease wear and increase the hold-down effect of the tool as it is pushed or pulled through the asphalt as shown in FIGS. 1 and 3. At the same time, the keepers 50 must remain in pressure contact with the top of the asphalt surface being cut. Thus, the tool 40*a* of FIG. 2 illustrates the basic principle of this invention and its wearing surfaces and cutting edges are subject to renewal by welding and related techniques. The tool 40*a* will, however, cut several miles of trench before it is discarded or repaired.

Referring to FIGS. 1 and 3, the cutting tools 40 and 40*b* incorporate the general parts of the cutting tool 40*a* of FIG. 2 and include the feature of having their keepers 50 adjustably mounted to the shanks 36. The tool 40 incorporates the wear plates of tool 40*c* while the tool 40*b* does not include these wear plates.

To this end, the keepers 50 are provided with the upright flanges 65 which are attached at their bottom edges by the weldments 66 to the tops of the keepers with their flat inner surfaces 68 against the flat surfaces 60 and in the plane of the inside surfaces 54 of the keepers. A dual series of vertically spaced bore holes 67 (illustrated in FIG. 7) is provided in each flange 65 which are co-axial in pairs to accommodate the cross bolts 70 on each side of the shank member 36. The holes 67 are laterally spaced so that the bolts 70 flank the front and rear surfaces 71 of the keepers.

The flanges are identically dimensioned and bored so that when the bolts 70 are inserted and tightened, the pair of keepers 50 are parallel and their bottom surfaces 72 (FIG. 4) are co-planar, with their inside cutting edges 56 contiguous to the angled cutting edges 46 of the angled tooth portion 44. In the embodiments of FIGS. 1 and 3 the tooth portions 44 are an integral part of the shank 36 with the cutting edges 46 formed of hardened steel for durability.

Thus, the keepers 50 of tools 40 and 40*b* can be vertically adjusted along the shanks 36 to any desired shearing position along the sides of lifter blade 44 to accommodate different depths of asphalt. This adjustment is accomplished by loosening the bolts 70 and sliding the keepers on the shanks to the new position. Upon tightening the bolts 70, the keepers are automatically oriented in a co-planar relationship on each side of the lifter blade 44.

The fore and aft spacing of each vertical series of bore holes for the bolts 70 can be such that with the bolts in place there is little if any space between the bolts and the front and rear surfaces 71. Thereby the angle at the juncture or corner 58 is always the same and does not change during use of the tool.

By providing some fore and aft spacing between the bolts 70 and the front and rear surfaces 71 of the shanks 36 in the tools 40 and 40*b*, the flanges 65 can be shifted or rotated to a degree before tightening the bolts 70 and thus change the angle at the juncture 58 (angle A, FIG. 7). To compensate for this change the vertical attitude of the shank 36 in relation to the asphalt surface being cut would be altered by the rams 24 to bring the under surfaces 72 of the keepers 50 into sliding contiguous contact with the asphalt surface.

The plow bolts 74 in each keeper of the tool 40 extend through and hold wear plates 76 shown in FIGS. 4 and 5 in relation to tool 40*c*. The wear plates 76 are rectangular pieces of extremely hard steel set into recesses 77 so that their bottom surfaces 78 are co-planar with the bottom surfaces 72 of the keepers 50. The plow bolts 74 have square shanks so that they will not rotate when the nuts are tightened and are seated within the recesses 80 so that the head 81 is flush with the bottom surface 78. The wear plates extend fore and aft of the corner juncture 58 so as to overlap a substantial portion of the cutting edges 46 and 56. Since no appreciable wear takes place along the outside edges or at the front 52 or rear 82 of the keepers 50, or each side of the corner juncture 58, there is no necessity for making the wear plates longer or wider. The keepers need be only wide enough to act as hold-downs.

In the embodiment of FIGS. 4 and 7, the shank member 36 has been modified to include a series of vertically spaced pairs of opposing transverse grooves 84 across the front and rear faces 71 into which the bolts 70 are engaged to provide both rigidity and step-wise adjustability to the assembly. In this alternative structure there is included the hardened cap member 90 which defines between its top wall 92, the side walls 94 and the bottom wall 96, an elongated tapered cavity 98 (see FIGS. 7 and 8A) to receive the modified tooth portion 46*a*, which has been reduced in three dimensions in a close fit relationship. The cap member 90 has the hardened cutting point 100 at its forward end which covers and protects the end 102 of the tooth 46*a* bringing same to the configuration of the blade portion 44 of FIG. 2.

Any suitable means can be employed for seating and attaching the cap member 90 to the modified tooth 46*a* including the arrangement shown wherein the inner end of cap member has the lobes 104 as extensions of the side walls 94 which fit into the arcuate recesses 106 (only one shown) on each side 60 of the bottom portion of the shank member 36. These recesses are defined by the off-set walls 108 and 110 in the modified tooth. As the cap member 90 is slipped upon the tooth the lobes 104 mate with the recesses 106 and the corresponding end wall 112 of the cap member fits against the walls 110 and 108 so that the outer surfaces of the side walls 94 are flat and co-planar with the sides 60 of the shank member and the bottom wall 96 is flush with the bottom 114 of the shank and extends at the same angle as shown in FIG. 7. The drift pin 115 engages through the bore holes 116 in the lobes 104 and through the bore hole 118 in the recesses 106 to lock the assembly. The drift pin 115 can be located at a mid-point of the side walls 94 if desired or a second drift pin can be used. There is essentially no thrust on the drift pin during use. Once in position, the end 102 can meet the inner narrow end 120 (FIG. 7) of the recess 98. The juncture of the side walls 94 and the top wall 92 now define the hardened cutting edges or corners 122 of the tool.

Figure 8:
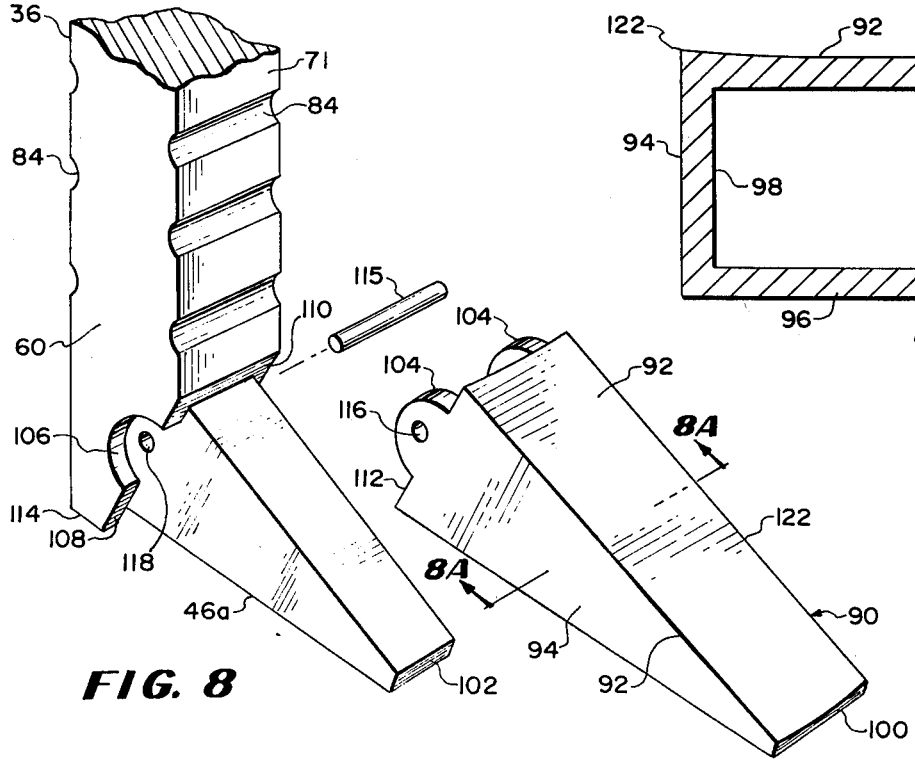
FIG. 8 is an exploded perspective view of the cutter blade of FIG. 3.
Figure 8A:
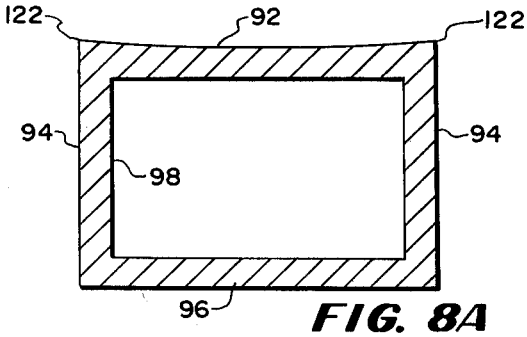
FIG. 8A is a cross-sectional view taken along the lines 8A of FIG. 8.

The top wall or surface 92 of the cam member 90 is preferably planar or slightly concave as shown in FIG. 8A. The cutting edges 122 and the inner cutting edges 56 of the keepers are essentially contiguous at the corner 58 and lie in substantially the same plane as indicated by the junctures 126 in FIG. 6. Thus, the blade or tooth portion is substantially the same width throughout the lengths of its cutting edges 122 as the space 128 between the side walls 54 of the keepers for cutting the asphalt or cement material with maximum efficiency.

When the tool of this invention is pulled by a prime mover in the direction of the arrow 130 in FIG. 1 or pushed at the front of a machine as shown in FIG. 3 by the arrow 132, the adjusting means 24–28 are actuated to force the tooth 46 into the asphalt layer 134. As the machine progesses the tool cuts the trench 136 causing the cuttings 138 to curl upwardly from between the two keepers at the front and leave the side walls 140 essentially straight and clean with little or no breakage or upheaval at the corners 142.

It is advantageous for the operator of the prime mover to be able to see the tool in operation and maintain sufficient downward thrust on the tool to insure that the keepers 50 are always in flat contact with the asphalt surface 134. As the grade changes, these adjustments can be made manually or automatically. The tip 48 of the tool is maintained at or below the bottom layer of the asphalt, into the grade proper, to maintain the hold-down effect of the tool due to the lifting action of the angled top surface of the blade portion 46.

Experiments have shown that the tool of this invention can cut a trench about 2½ inches wide and 5 inches deep at a rate of 1½ to 2 miles per hour or more. One model like that shown in FIG. 2 was able to cut a trench 2½ inches wide and 3 miles long at a rate of 5 mph with only 20% –30% wear.

During these tests it was found that the angle A (see FIG. 7) between the cutting edges 56 of the keepers 50 and the flat or concave surface 192 of the tooth portion 46 was essentially critical to the production of a clean cut trench. This angle is preferably about 40° and can be varied by about 5°, i.e., can be 35° to 45° without disrupting this relationship. As the angle is reduced to below 35°, the tip 48 of the tool burns more and its life is shortened. Also it becomes more difficult to start the cutting operation. With a reduced angle A the keepers 50 must be made to extend further forward of the cutting tip end 48 or 104 of the tool and any undulations in the grade or the machine have a greater effect on the cutting efficiency. The wear of the tip with the angle A at 35° is about 20% more than with the angle A at 40°. As the angle A is made greater than 45°, the power required to pull the tool through the asphalt is increased markedly. If A is 90° the power requirement is tremendous and cutting ceases.

Another factor influencing tool life is the shape of the top surface 192 of the tooth portion 46. With the crown on this surface 192, instead of a concavity the shearing action of the blade diminishes and disappears and the tool tends to pry the asphalt up in pieces leaving a ragged edge. In one experiment it was found that a crowned top surface increased the power requirements by 20% to 30%. A concavity of about ¼ inch for a blade about 2 – 2½ inches wide was found to be optimum. Any deeper cavity caused excessive wear on the cutting edges 122. The tool requires much less power to pull with the keepers in place than with the keepers removed or raised out of contact with the asphalt surface 134.

It is apparent that the shank 36 shown in FIG. 8 can have a pair of keepers 50 welded to its sides and used with the replaceable cap member 90 as still another embodiment. The up-turned ends 52 of the keepers 50 extend forward of the shank at least as far as the cutting points 48 and 100 of the lifter blade 46 and 46*a*, respectively, so that a compression or hold-down force is applied to the paving from the corner 58 to the area directly above these cutting points. Preferably, the forward ends 52 extend somewhat beyond, as illustrated. There is no necessity for the keepers 50 to extend rearwardly of the shank any more than that shown in the drawings and a shorter rear extension could be used.

The tool of this invention is used to cut trenches and trim the edges of paved roads, drives and walks made of asphalt-like materials to include asphalt, bituminous, black top, seal coatings (tar and pea gravel) and soil cement which are generally laid in thicknesses of 1 inch increments depending on the specifications. A primary use is to trim the ragged outer edge of an asphalt or soil cement roadway in preparation for laying another new layer adjacent thereto in widening and repairing. For this purpose only one keeper can be used on the inboard side (the side away from the ragged edge) as long as the tool is cutting at least 6 inches or less from the outer edge. By using a pair of keepers 50 a narrow portion of asphalt can be trimmed off close to the edge while maintaining the outboard keeper on the side grade, provided it is substantially co-planar with the asphalt layer. For cutting rounded edges of a roadway the tool need only be drawn along a line where the outer keeper makes contact with the top of the asphalt layer. It is impossible to cut and trim the ragged edge of an asphalt layer by using the tip end of a mold-board powered by a prime mover no matter the angle of approach of the cutting edge without causing the machine to spin out. The tool of this invention is capable of making a clean cut along a designated path in as sharp a curve as the prime mover can negotiate with the tool in full cutting relationship without fish-tailing. Such steering capacity is not possible with the cutter blades of the prior art which tend to veer off the desired path.

It is advantageous to adjust the keepers 50 in relation to the top surface 192. This relationship is shown in FIG. 7 by the broken line 72' representing the lowered position of the keepers 50 which are maintained in a plane transverse and opposite to the cutting edges of the tooth. This adjustment which is generally made in on inch increments by the spacing of the grooves 84 allows the operator to keep the point 48 or 104 in the sub-grade below the bottom of the asphalt, thus prolonging its life and extending the wear areas at the junctures 58 along the surface 72 or along the wear plates 76 to still further prolong the life of the tool. One advantage of being able to make a clean cut in the asphalt with no upheaval at the side walls 140 or corners 142 is that only the necessary amount of debris or cuttings is formed and parallel cuts can be made in a roadway, followed by a bulldozer or scraper to pick up the layer of asphalt between the cuts. Such a function is not possible with the scarifying teeth since they leave large pieces of disrupted asphalt on each side of the jagged cut which must be negotiated by the machine on the next pass. The undulations of the machine make it difficult, if not impossible, to maintain the scarifying teeth in digging relationship with the asphalt.

The alternative form of cutting device shown in FIGS. 9–12 is designed for use with road graders as the motive machines. Instead of mounting by means of a shank such as shank 36, FIG. 2, the cutter head is mounted directly to the scraper blade structure of the grader. With this arrangement, the position of the cutter head is controlled by the blade controls of the grader.

As in the cutters already described, the functional parts forming the cutter head 200 comprise a pair of spaced, parallel, co-planar keepers 201 and 202 and a lifter blade 203 having an inclined top surface 204 and flat sides 205 and 206 which are substantially respectively co-planar with inner surfaces 207 and 208 to provide shearing edges 209, 210, 211 and 212.

Lifter blade 203, which is replaceable and may be supplied in a range of differing lengths to cut trenches of different desired depths, is supported by a permanent tooth 213 which is welded to a plate 214 which, in turn, is welded to the top surfaces of keepers 201 and 202. The lifter blade is driven onto the supporting tooth in accordance with usual practice and may be removed by knocking it off from on top. A supporting back-up stop 215, also welded to plates 214, provides additional strength.

Figure 9:
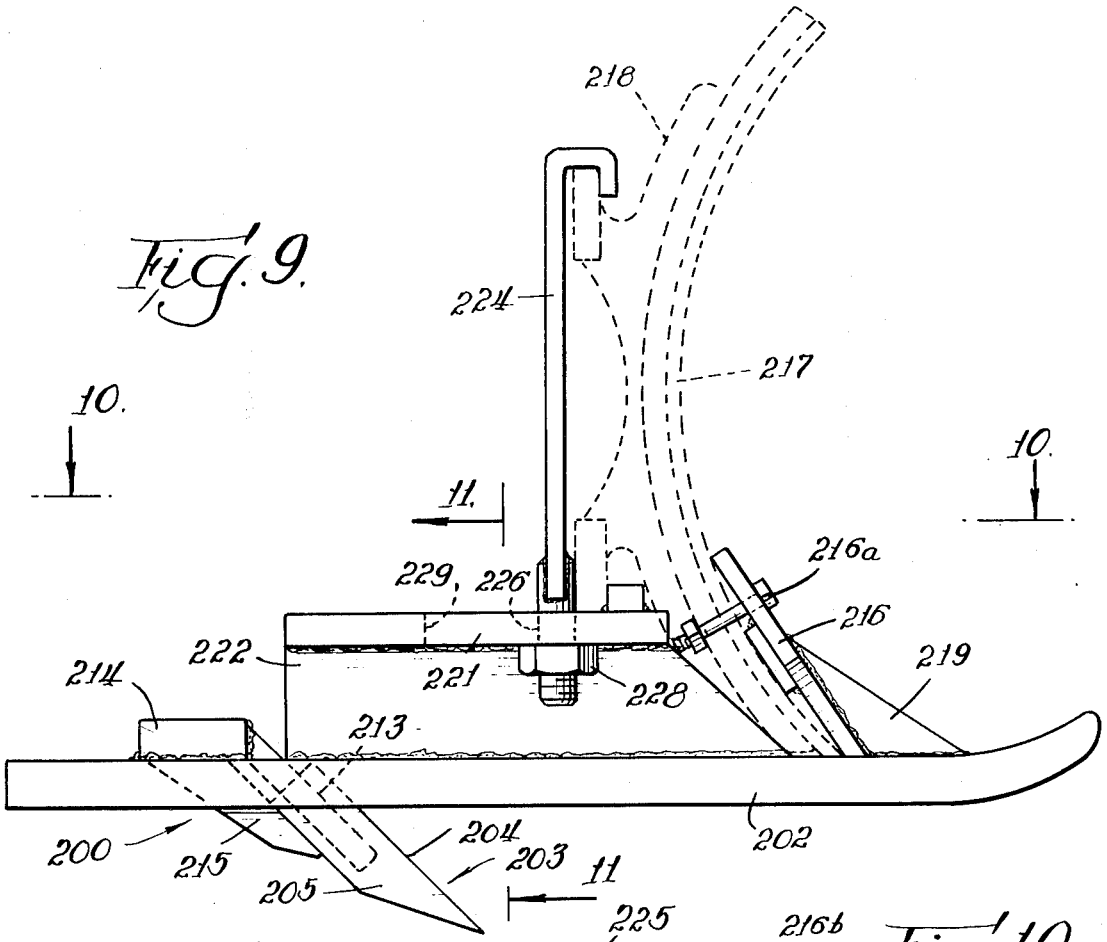
FIG. 9 is a side view of another form of cutter device mounted on the blade structure of a grader.
Figure 10:
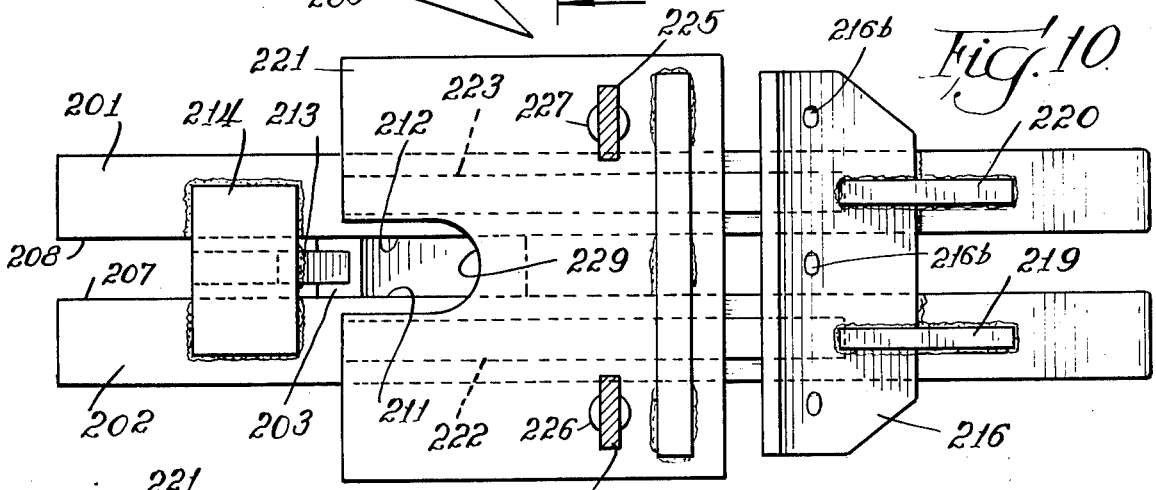
FIGS. 10 and 11 are cross-sectional views taken at the lines 10—10 and 11—11, respectively.
Figure 11:
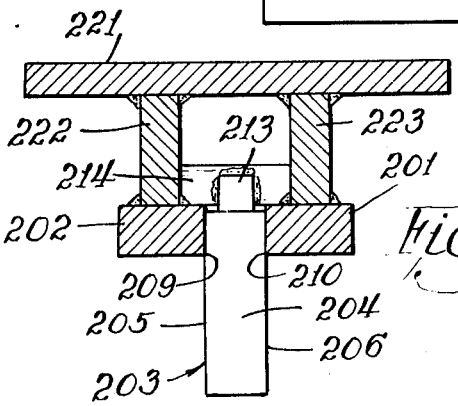

A plate 216, inclined at approximately the angle of the lower portion of the scraper blade 217, shown, along with its supporting structure 218, in dotted lines in FIG. 9, extends across the forward part of the keepers and is welded thereto by gussets 219 and 220. For the purpose of mounting the cutter head to the scraper blade of the grader, a platform is arranged above the keepers and welded thereto by means of a pair of web plates 222 and 223. A pair of hooked clamping bolts 224 and 225 pass through holes 226 and 227 in platform 221, as shown.

The cutter head may be firmly mounted to the scraper blade of a grader in the manner indicated in FIG. 9. The assembly is snugged up against the bottom edge of the blade at the juncture of plate 216 and the keepers with the forward part of the platform 221 engaging the bottom of the normal blade-supporting structure of the grader. Bolts 216*a* pass through holes 216*b* in plate 216 and the aligning holes in the scraper blade structure, which are normally provided for the wear plate blade, securely holding the forward part of the cutter head in position. The clamping bolts are hooked over the grader blade structure and nuts 228 firmly tightened to complete the mounting of the cutter head to the scraper blade structure.

The operation of this cutter head is as heretofore described. By maneuvering the scraper blade with the grader controls, the cutter head may be leveled and lowered as the grader is driven forward so that the lifter blade extends downwardly into the material to be cut and the keepers engage the surface of the pavement or other material. A recess 229 is provided in platform 221 to permit the free passage of the asphalt or other material as it is cut and passes along the top of lifter blade 203 and eventually to one side or the other of the cutter head.

Figure 12:
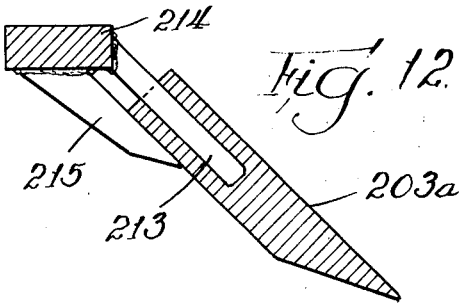
FIG. 12 is a detail view in cross section showing a blade longer than that of FIG. 9 for making a deeper cut.

As already mentioned and as shown in FIG. 12, the cutter head may be fitted with the length of lifter blade needed to cut trenches of the desired depth. Lifter blade 203*a* is longer than blade 203 and will therefore cut more deeply than the latter.

The cutting device of this invention can be used to cut trenches in and trim the edges of a variety of bituminous and cementous compositions used in paving having the characteristics of asphalt and soil cement, as distinguished from concrete. These compositions are described for purposes of this disclosure as being asphalt-like materials. It will be understood that it can be driven by any suitable prime mover, including, for example and in addition to equipment herein already referred to, a back hoe.

I claim:

1. A cutter head for a cutting device for forming a narrow trench in a layer of asphalt-like material along a straight or curved path of travel comprising:

a lifter blade having an approximately flat upper surface engageable under and against said layer and extending, in use, at an angle downwardly in the direction of the path of travel;

said lifter blade having essentially vertical planar opposite side walls extending in the direction of the path of travel and intersecting with said flat upper surface at approximately right angles to define a pair of laterally spaced cutting edges;

a flat keeper member rigidly mounted on each side of said lifter blade;

said keeper members presenting essentially co-planar flat under surfaces intersecting with said upper surface of said lifter blade and positionable in use upon the top of said layer;

each of said keeper members having an inner cutting edge substantially in the plane of the associated side of said lifter blade and at least co-extensive with the associated cutting edge of said lifter blade;

and means for drivingly mounting said cutter head upon a prime mover.

2. A cutter head in accordance with claim 1 wherein the lifter blade is removable and interchangeable with blades of differing lengths whereby to adapt said cutter head for cutting trenches of various pre-determined depths.

3. A cutter head in accordance with claim 1 in which:

the angle between each of said cutting edges and the inner edge of said keeper members is about 35° to 45°.

4. A cutter head in accordance with claim 1 in which:

the angle between each of said cutting edges and the inner edges of said keeper members is about 40°.

5. A cutting device in accordance with claim 1 in which:

said lifter blade includes a replaceable hardened cap member defining said upper surface, vertical opposite side walls and cutting edges.

6. A cutting device in accordance with claim 1 in which:

said flat keeper members are provided with recesses extending along said co-extensive portion; and replaceable wear plates are provided for insertion into said recesses to define said inner edges associated with and in the plane of said cutting edges of said lifter blade.

7. A cutter head in accordance with claim 1 and including means for mounting said cutter head at the bottom of the structure of the scraper blade of a grader.

8. Structure in accordance with claim 7 wherein said means for mounting said head includes a plate extending across and welded to the front portions of the keeper members, a support structure extending across and welded to the middle portion of said keeper members and spaced from said first-mentioned plate to provide a socket-like recess adapted to receive the bottom of the scraper blade structure, and clamping means extending upwardly from said support structure for drawing said structure and cutter head firmly upwardly against the scraper blade structure.

9. A cutter head for a cutting device for forming a narrow trench in a layer of asphalt-like material along a straight or curved path of travel comprising:

a lifter blade having an upper surface which is slightly concave in cross-section and is engageable under and against said layer and extending, in use, at an angle downwardly in the direction of the path of travel;

said lifter blade having essentially vertical planar opposite side walls extending in the direction of the path of travel and intersecting with said flat upper surface at approximately right angles to define a pair of laterally spaced cutting edges;

a flat keeper member rigidly mounted on each side of said lifter blade;

said keeper members presenting essentially co-planar flat under surfaces intersecting with said upper surface of said lifter blade and positionable in use upon the top of said layer;

each of said keeper members having an inner cutting edge substantially in the plane of the associated side of said lifter blade and at least co-extensive with the associated cutting edge of said lifter blade;

and means for drivingly mounting said cutter head upon a prime mover.

10. A cutting device for forming a narrow trench in a layer of asphalt-like material along either a straight or curved path of travel without side wall disruption, comprising:

a vertical shank member having two substantially flat sides and a lifter blade extending at an angle downwardly from the bottom end of said shank member in the direction of the path of travel;

said lifter blade having an approximately flat upper surface engageable under and against the asphalt-like material of said layer and having essentially vertical opposite side walls respectively co-planar with said sides of said shank member and intersecting with said flat upper surface at substantially right angles to define a pair of laterally spaced cutting edges;

A flat keeper member rigidly carried by said shank member on each side thereof;

said keeper members presenting essentially co-planar flat under surfaces intersecting with said flat upper surface of said lifter blade and positionable in use upon the top of said layer;

each of said keeper members having an inner edge substantially in the plane of and at least co-extensive with the associated cutting edge of said lifter blade.

11. A cutting device in accordance with claim 10 in which:

the angle between each of said cutting edges and the inner edges of said keeper members intersecting therewith is about 35° to 45°.

12. A cutting device in accordance with claim 10 including:

means to adjust said keeper members vertically in relation to said spaced cutting edges along the effective length of said lifter blade.

13. A cutting device in accordance with claim 12 in which:

said vertical adjustment means includes a pair of flanges affixed to said keeper members and extending on opposite sides of said shank member; and means are provided to rigidly attach said flanges at selected heights along said shank member.

14. A cutting device in accordance with claim 13 in which:

said means to rigidly attach said flanges to said shank member include:

a pair of identical vertical rows of spaced holes in said flanges, said rows being spaced apart sufficiently to permit bolts passing through the holes of opposite flanges to pass by said shank member in clamping the same to said shank member.

15. A cutting device in accordance with claim 14 wherein:

the front and rear of said shank members are provided with spaced horizontal grooves coordinated with said rows of holes in said flanges to accommodate the flange clamping bolts in said grooves.

16. A cutting device in accordance with claim 10 in combination with a prime mover:

said prime mover having draw bar means to hold said shank member in a vertical position therefrom; and means connected to said draw bar to adjust the vertical height and vertical angle of said draw bar and cutting device to maintain said keeper members in contact with said layer of asphalt-like material.

17. A cutting device for trimming the ragged edge of a layer of asphalt-like material to a clean cut comprising:

a shank member having an integral tapered lifter blade extending downwardly at an angle therefrom with a cutting tip at the forward end;

said lifter blade having a substantially planar upper surface with a vertical substantially flat side wall intersecting with said upper surface along one side to define a square cutting edge;

an elongated keeper member on said shank member;

said keeper member having a planar under surface and substantially flat side defining at the lower corner a second square cutting edge extending fore and aft of the cutting edge of said lifter blade and substantially co-planar therewith whereby movement of said cutting device along said ragged edge of said layer of asphalt-like material with said planar under surface of said keeper member in contact with said layer and with said cutting tip extending to the bottom of said layer produces said trimmed edge.

18. A cutting device in accordance with claim 17 in which:

said lifter blade includes a cutting edge along the other side thereof;

a second elongated keeper member is provided on said other side of said lifter blade;

said second keeper member having a planar under surface co-planar with said other keeper member and its substantially flat side defining at the lower corner a further square cutting edge extending fore and aft of the cutting edge of said lifter blade.

* * * * *